United States Patent [19]

La Mell et al.

[11] 4,160,972

[45] Jul. 10, 1979

[54] ALARM APPARATUS FOR MOVABLE BARRIER MEMBERS

[75] Inventors: Kenneth La Mell, Ridgewood, N.J.; Gerry Schneider, Irvington-on-Hudson, N.Y.

[73] Assignee: ADCO Venetian Blind Company, New York, N.Y.

[21] Appl. No.: 906,996

[22] Filed: May 18, 1978

[51] Int. Cl.[2] ..... G08B 13/08

[52] U.S. Cl. ..... 340/541; 200/61.84; 200/61.93; 340/545; 340/547

[58] Field of Search ..... 340/545, 541, 547, 530; 200/61.84, 61.93

[56] References Cited

U.S. PATENT DOCUMENTS

| | | | |
|---|---|---|---|
| 1,392,641 | 10/1921 | Havran | 200/61.84 |
| 2,287,382 | 6/1942 | Livingston | 200/61.84 |
| 2,293,609 | 8/1942 | Livingston | 200/61.84 |
| 3,009,138 | 11/1961 | Lindsay | 340/545 |
| 3,668,582 | 6/1972 | Lea | 200/61.93 |
| 3,706,090 | 12/1972 | Callaghan | 200/61.84 |
| 3,710,369 | 1/1973 | Takahashi | 200/61.93 |
| 3,943,485 | 3/1976 | Waldman | 200/61.93 |

*Primary Examiner*—Glen R. Swann, III

*Attorney, Agent, or Firm*—Lerner, David, Littenberg & Samuel

[57] ABSTRACT

A normally-open magnetic reed switch is mounted on the bottom of a venetian blind or similar barrier and a magnet is mounted in the window sill to hold the switch closed when the barrier is in its normal position. When closed, the switch shorts a timing capacitor in an associated alarm circuit. If the switch moves away from the magnet (thus allowing the switch to open) long enough for the timing capacitor to charge, an alarm signal is produced. Thus an alarm will not be produced by trivial movements of the barrier.

10 Claims, 3 Drawing Figures

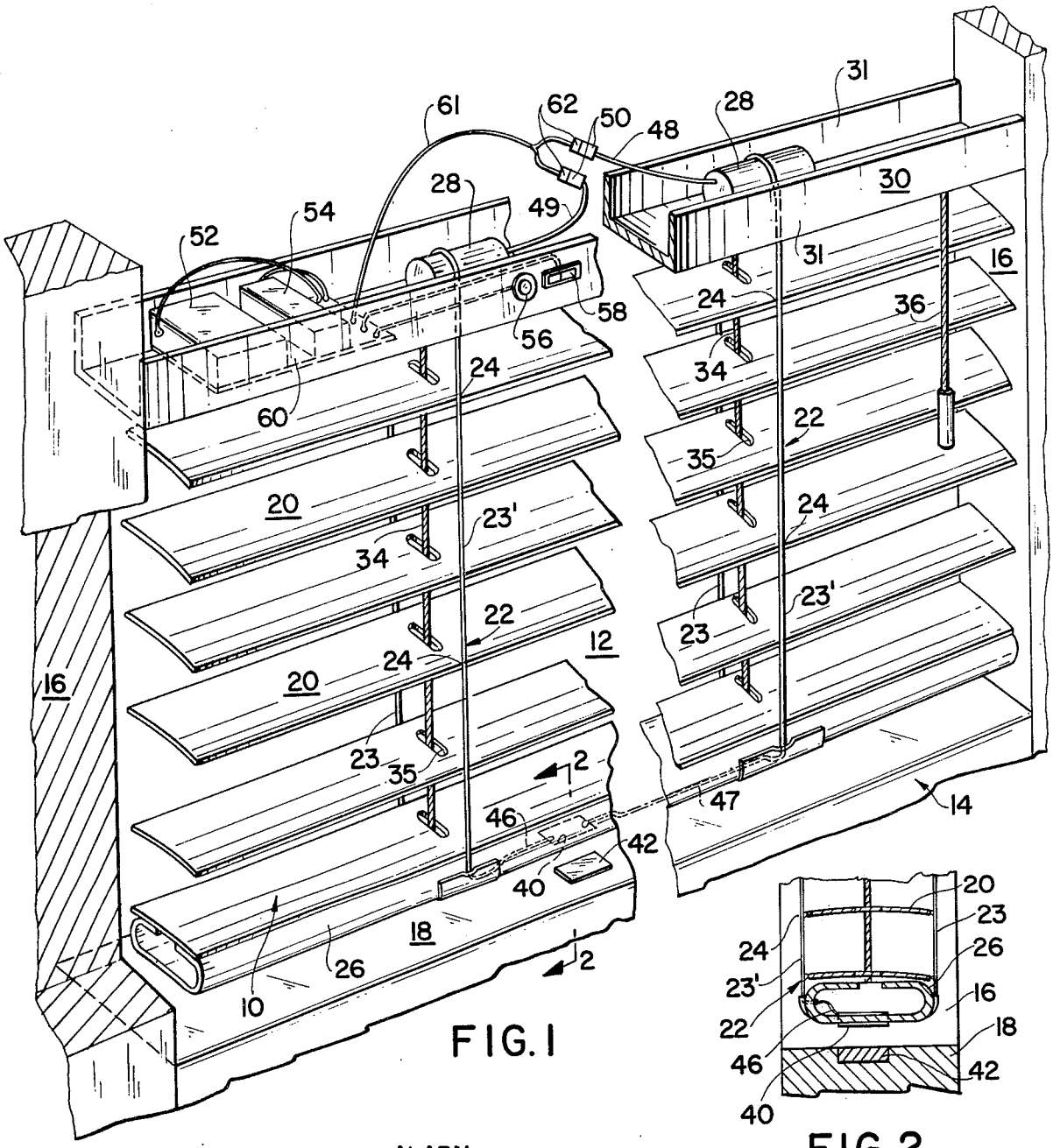
FIG. 1
FIG. 2
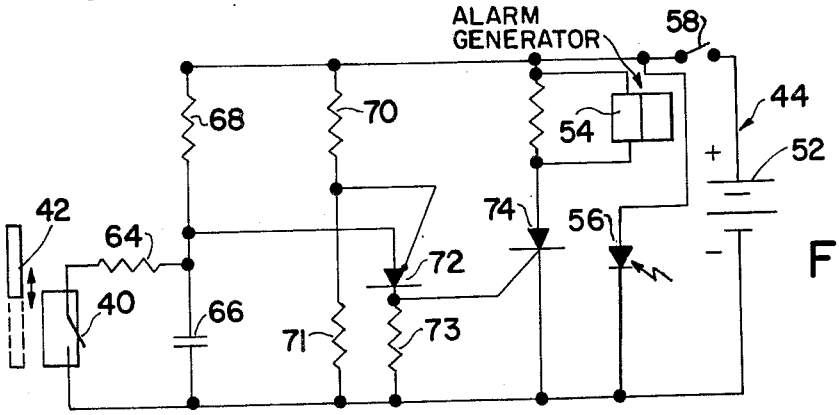
FIG. 3

ALARM APPARATUS FOR MOVABLE BARRIER MEMBERS

BACKGROUND OF THE INVENTION

The present invention relates to an alarm apparatus, and more particularly to alarm apparatus for movable barrier members positioned in openings defined by frame members. For example, the alarm apparatus of the present invention is particularly useful as a burglar alarm for windows having venetian blinds or other types of shade or curtain type members which are movable in the window opening.

In prior art burglar alarm systems or alarm apparatus for windows and the like having flexible or movable barrier members, the alarms have been physically attached to the flexible movable barrier members and the barrier members in turn physically restricted or restrained from being freely movable relative to the window frame. Then, any movement of the barrier causes the alarm to be actuated. As can be appreciated, such an arrangement hampers normal use of the barrier member and/or requires complicated hardware or apparatus for holding the barriers fixed in the window openings. Further, the restraining apparatus such as locks, hooks, etc. has resulted in an unslightly and non-aesthetic appearance for the barrier members mounted in the openings. Consequently, such prior art alarm systems for blinds or flexible barrier members have not been widely used in the past.

For example, in U.S. Pat. Nos. 2,287,382 and 2,293,609, both to Livingston, for "Barrier Alarms", there is disclosed alarm apparatus for venetian blind type barriers or the like in which the blind is held in fixed position with respect to the window frame by means of bolts or studs attached to the blinds and hook members attached to the window frame. The studs are disposed in a non-contact relationship within the hook members, and an electrical circuit is connected to the studs and hook members so that movement of the blind will cause contact of the studs with the hook members on the window frame, thereby completing the electrical circuit and generating an alarm signal. However, as can be appreciated, activation of the alarm circuit requires that the studs first be physically placed within the hook members. Further, the studs and hook members provided in the Livingston devices are not aesthetically pleasing.

In U.S. Pat. No. 3,668,582 to Lea for "Trap Switch Constructions in Normally Closed Protective Circuits of Burglar Alarm Systems", there is disclosed another type of alarm system or device for a venetian blind type flexible barrier in windows. In this patent, an alarm circuit is normally closed by means of a "trap wire" held taut across the window opening and contacting electrical contacts on either side of the opening. The circuit is such that an alarm signal is generated whenever the contact of the trap wire is broken. Normally, the trap wire is carried by the venetian blind, and consequently, movement of the blind within the opening causes the contact of the trap wire to break and an alarm signal to be generated. Accordingly, as can be appreciated, this alarm device also suffers from the same deficiency as the Livingston devices—namely, the trap wire has to be set before activation of the alarm circuit, and the trap wire and the electrical contacts on either side of the window have resulted in an unsightly appearance for the blind in the window opening.

While other types of alarm systems for window openings exist which do not result in the generation of false alarms, such systems are generally for the windows themselves and not for the flexible or movable shades or blinds. As can be appreciated, complicated restraining means for the windows are not required, nor are the windows generally susceptible to movement as a result of momentary wind disturbances and the like. For example, in U.S. Pat. Nos. 3,710,369 and 3,943,485, window alarm systems are shown in which magnets and reed switches are employed to sound an alarm upon proximity or lack of proximity of the magnets to the reed switch. Movement of the window frame, and thus movement of the magnet relative to the reed switch, is not normally free and unrestricted. Consequently, such alarm devices for windows are not generally susceptible to the same problems associated with blinds or barrier members which are normally freely movable in the window opening as a result of momentary wind disturbances and the like.

SUMMARY OF THE INVENTION

These and other disadvantages of the prior art are overcome with the alarm apparatus of the present invention which is particularly adapted for use with normally freely movable barrier members positioned in an opening defined by a frame member. In accordance with the present invention, the alarm apparatus comprises switch means for mounting on one of the frame and barrier members, and actuating means for mounting on the other member. The switch means is switchable between a first operative state and a second operative state and is normally in the first operative state. The actuating means serve to switch the switch means to the second operative state when the actuating means is in a predetermined position relative to the switch means. Timing means which is responsive to the switch means being in the first operative state for greater than a predetermined period of time is provided for generating an alarm condition signal. Alarm generating means is then provided which is responsive to the alarm condition signal for generating an alarm. In this way, the barrier member can remain freely movable relative to the frame member and an alarm not be generated as a result of minor movement of the barrier member relative to the frame member. In other words, minor movements of the barrier member relative to the frame which may result, for example, from wind disturbances and the like, are permitted without generation of a false alarm signal. An alarm signal instead is only generated when the barrier member remains out of the predetermined position for greater than the predetermined period of time.

In the preferred embodiment of the present invention, the switch means comprises a proximity detector and the actuating means comprises a proximity member which is adapted to switch the operative states of the proximity detector depending upon the proximity of the proximity member relative to the proximity detector. For example, in a further preferred embodiment, the proximity detector comprises a reed switch and the proximity member comprises a magnet. When the proximity member and the proximity detector are proximate to one another, the proximity detector is in the second operative state so that an alarm condition signal is not generated. However, when the proximity detector and proximity member are moved out of proximity to one another, the proximity detector switches to the first operative state, and, if the proximity detector remains in such first state for greater than a predetermined period of time, an alarm condition signal will be generated, which in turn will generate an alarm. On the other hand, if the proximity member and proximity detector are moved back into proximity with one another, generation of the alarm condition signal is prevented.

It should be noted that with the present invention, restraint of movement of the movable barrier member in the opening is not necessary in order to prevent generation of false alarms. Rather, generation of the alarm condition signal is delayed for a short period of time, thereby permitting minor movement of the barrier member which may be the result of wind disturbances or minor swaying movements without generating an alarm. Only when the actuating means and the switch means are not in the predetermined position for greater than the predetermined period of time is the alarm condition signal generated which in turn will result in an alarm being generated.

These and other advantages and characteristics of the present invention will be apparent from the following detailed description of the preferred embodiment thereof in which reference is made to the accompanying drawings.

BRIEF DESCRIPTION OF THE DRAWINGS

FIG. 1 is a perspective view, partly broken away, of a movable barrier member within a frame opening in which the alarm apparatus in accordance with the present invention is utilized;

FIG. 2 is a sectional elevational view taken along lines 2—2 of FIG. 1, illustrating the proximity detector and proximity member in accordance with the present invention; and FIG. 3 is a schematic circuit diagram of the electrical circuit of the alarm apparatus of the present invention.

DETAILED DESCRIPTION OF THE PREFERRED EMBODIMENT

Referring now to the drawings in which like reference numerals represent like components, there is shown in FIG. 1 the alarm apparatus of the present invention utilized in connection with a conventional venetian blind assembly 10 disposed in a window opening 12 defined by a window frame 14. Although the present invention will be described with reference to such a venetian blind assembly in the window opening, it should be understood that the alarm apparatus may also be used in connection with any movable barrier member disposed in an opening defined by a frame member, such as for example, door openings, openings in room partitions, etc.

The window frame 14 comprises vertical frame side members 16, a lower window sill 18, and an upper window sill (not shown) to define a generally rectangular opening 12. As is conventional, the window opening generally includes window sashes (not shown) which are vertically slidable within the window frame 14 for opening and closing the opening 12. The venetian blind assembly 10 includes a plurality of horizontally arranged slats 20 supported by a pair of spaced, vertically oriented guide ladders 22. The guide ladders 22 each comprise a pair of guide lines 23, 23' extending on opposite sides of the slats 20 and to which the opposite edges of the slats 20 are fixably secured, as at 24. Alternatively, horizontal rungs fixed to the guide lines 23, 23' may be provided on which the slats 20 would rest. The lower ends of the guide lines 23, 23' are fixably secured to the lower or bottom rail 26 of the blind assembly 10, and the upper ends are secured to a rotatable drum 28. Of course, a single guide line could be provided in place of the dual guide lines 23, 23' in which case, the single guide line would extend downward along one side of the slats 20, loop underneath the bottom rail 26, and up the other side of the slats 20. The rotatable drums 28 for each of the guide ladders 22 are supported in the upper channel 30 of the blind assembly 10, and are operatively connected to rotate together to adjust the angular orientation or tilt of the slats 20, as is conventional.

The upper channel 30 of the blind assembly 10 is supported between the upper ends of the frame side members 16 by appropriate brackets (not shown) with the slats 20 and bottom rail 26 extending downwardly therefrom. Raising and lowering of the blind assembly 10 in the window opening 12 is accomplished in a conventional manner by means of lift lines 34 secured to the bottom rail and passing upwardly through central openings 35 in each of the slats 20 and into the upper channel 30. In the upper channel 30, a conventional pulley system (not shown) is provided for the lift lines 34, and the lines 34 are joined together to form a lift cord 36 which extends to one side of the blind assembly 10 and passes downwardly through the upper channel 30. Thus, by pulling the lift cord 36, the bottom rail 26 will be lifted vertically, thereby compressing the plurality of horizontal slats 20, to raise the blind assembly 10. Lowering of the blind assembly 10 is accomplished by releasing the lift cord 36 and allowing it to retract into the channel 30. A cord lock assembly (not shown) may also be provided for locking the blind assembly 10 in any desired vertical position.

It is to be noted that when the venetian blind assembly 10 is lowered within the window frame opening 12, the horizontal slats 20 and bottom rail 26 are free to move or swing relative to the window frame 14, as the blind assembly 10 is only supported at its upper end by the upper channel 30. For example, such movement may be the result of wind disturbances, such as when the window is open, or the result of other disturbances in the air, such as when doors are opened and closed, etc. In the past, conventional alarm systems for detecting and warning an occupant of an attempt to illegally enter the residence through a window in which the venetian blind is positioned have been physically attached to the blind assembly and the blind assembly in turn physically restricted or restrained from being freely movable relative to the window frame. The prior art alarm apparatus is adapted to detect movement of the blind. Thus, when an intruder attempts to enter by either pushing the blind aside or cutting the guide lines, a circuit is activated and an alarm would sound, thereby warning the occupant. As can be appreciated, such an arrangement hampers normal use of the barrier member and/or requires complicated hardware or apparatus for holding the barriers fixed in the window openings. Further, the restraining apparatus such as locks, hooks, etc. has resulted in an unsightly and non-aesthetic appearance for the barrier members mounted in the openings. Consequently, such prior art alarm systems for blinds or flexible barrier members have not been widely used in the past.

These disadvantages of the prior art are overcome with the present invention which utilizes switch means 40 switchable between first and second operative states and normally in the first operative state, actuating means 42 for switching the switch means to the second operative state when the actuating means 42 is in a predetermined position relative to the switch means 40, and timing means responsive to the switch means 40 being in the first operative state for greater than a predetermined period of time for generating an alarm condition signal. Alarm generating means 54 are then provided which is responsive to the alarm condition signal for generating an alarm. In other words, the timing means serve to delay actuation of the alarm for a short period of time so as to avoid generation of false alarms which might otherwise result from movement of the blind caused by wind or other disturbances. Accordingly, the present invention avoids the necessity of physically restraining movement of the blind 10. Instead of any movement of the blind 10 setting off the alarm, only movement which causes the blind to be away from the window frame for a period greater than the delay time, such as might occur when an intruder pushes the blind 10 aside or cuts the guide lines 23, will activate the alarm.

More specifically, referring to FIGS. 1 and 2, the switch means and actuating means in the preferred embodiment comprise a magnetic reed switch 40 and a magnet 42, respectively. The reed switch 40 is mounted in the lower rail 26 of the venetian blind 10, and the magnet is disposed in the upper surface of the lower window sill 18 in close proximity to the reed switch 40 when the blind 10 is in its lowered position and hanging vertically in the window opening 12. The reed switch 40 senses the proximity of the magnet 42 relative thereto, and so long as the two are in close proximity to one another, no alarm condition signal is generated in the electrical circuit 44, to be described more fully hereinbelow. However, when the blind 10 is moved relative to the window frame 14, the reed switch 40 is moved out of proximity to the magnet 42 which thus causes the reed switch 40 to change operative states. If the reed switch 40 and magnet 42 remain out of proximity for too great a time, an alarm condition signal will be generated which in turn will activate the alarm generating means 54. It is to be noted that the movement of the reed switch 40 out of proximity with the magnet 42 can either be the result of normal minor movements of the blind 10 due to wind disturbances or other air disturbances in the area of the blind 10, or the result of an attempt by an intruder to enter the residence through the window opening 12 in which the blind 10 is positioned.

As shown in FIG. 1, the reed switch 40 includes two electrical wires 46, 47 which are connected to respective guide lines 23' of the pair of guide ladders 22. The guide lines 23' are each provided with an electrical conductor which extends upwardly into the upper channel 30 of the venetian blind assembly 10. In the upper channel 30, the electrical conductors inside the guide lines 23' are each connected to respective electrical wires 48, 49 having snap-on connectors 50 at the opposite ends thereof. The electrical connection of the wires 48, 49 to the electrical conductors in the guide lines 23' can, for example, be made within the rotatable drum 28 to which the guide lines 23, 23' are connected. The wires 48, 49 are in turn connected to the remainder of the electrical circuitry 44 for the alarm system, by means of the snap-on connectors 50. While the guide lines 23' provide a convenient means for electrically connecting the reed switch 40 to the remainder of the alarm circuitry, it should of course be realized that other means could be utilized, such as for example, concealing the electrical conductors within the lift lines, or within tapes or straps utilized for holding the slats of other types of venetian blind assemblies.

The electrical circuitry 44, as shown in FIGS. 1 and 3, includes a battery 52, an alarm generating device 54, a light emitting diode indicator (hereinafter LED indicator) 56, a master on/off switch 58, and a circuit board 60 having printed wiring thereon. These components are all housed within the upper channel 30 of the blind assembly 10. The battery 52 serves to supply power to the electrical circuitry 44 and is mounted on the circuit board 60 by means of snap-on contacts (not shown). The alarm generating device 54 sounds an alarm when actuated and is also mounted on the circuit board 60 and wired into the circuitry 44. The alarm generating device 54 in the embodiment shown comprises a loud buzzer, but of course, it should be understood that other types of alarms could also be utilized. The master on/off switch 58 which serves to apply the power of the battery 52 to the electrical circuit, and the LED indicator 56 which serves to indicate that the circuit is activated, are also wired into the circuit board 60. At the circuitry end of the board 60, the remaining components comprising the circuit are mounted into printed wiring on the board 60 in a conventional manner. The board 60 also includes a wire 61 having two pin contacts 62 to which the snap-on connectors 50 of the electrical conductors 48, 49 can be connected to complete the electrical circuit. The battery 52, alarm generating device 54 and circuit board 60 are all mounted between the facings 31 of the upper channel 30 so as to be concealed from normal view, while the LED indicator 56 and master on/off switch 58 are both mounted in the facing 31 which faces into the interior of the house so that the indicator 56 is visible and the master on/off switch 58 accessible to an occupant in the house.

Referring to FIG. 3 there is shown a schematic representation of the switch 40, actuator 42 and associated electrical circuitry 44 which is useful for describing the operation and functioning of the alarm apparatus of the present invention. The reed switch proximity detector 40, which is normally in an open position, is closed when the actuator or magnet 42 is in close proximity thereto. The switch 40 is employed to discharge a capacitor 66 through a resistor 64 when it is closed. Since in operation the magnet 42 is normally in close proximity with the switch 40, the capacitor 66 is normally in a discharged condition. The capacitor 66 is connected in series with resistor 68, both of which are connected across a battery 52 when the master on/off switch 58 is closed. The light emitting diode 56 is actuated when the switch 58 is closed, indicating that alarm circuit 44 is in operation. When the switch 58 is closed, current flows through resistor 68. When the reed switch 40 is also closed (as a result of its proximity to magnet 42) the current flows through resistor 68, passes through resistor 64 and reed switch 40 to ground. When the magnet 42 is moved out of proximity with the reed switch 40, thereby opening switch 40, the current flowing through resistor 68 begins charging capacitor 66 at a rate dependent upon the product of the resistance of resistor 68 and the capacity of capacitor 66. If the voltage at the junction of capacitor 66 and resistor 68 reaches a predetermined level determined by bias resistors 70, 71, semiconductor device 72 is triggered to provide a pulse across resistor 73, which in turn triggers semi-conductor device 74 to actuate the alarm generating device 54. In the preferred embodiment, this delay time is on the order of ½–1½ seconds before semi-conductor device 72 is triggered. If on the other hand, the reed switch 40 is closed prior to the voltage at the junction of capacitor 66 and resistor 68 reaching the predetermined level, the capacitor 66 is discharged through resistor 64 and closed switch 40, thereby preventing activation of the alarm generating device 54.

Normally, the value of resistor 64 is much lower than the value of resistor 68 so that the capacitor 66 rapidly discharges when the reed switch 40 is closed. For example, the value for resistor 68 in the embodiment shown, is one megohm whereas the value for resistor 64 is only ten kilohms. Also, in the embodiment shown, the value for the capacitor 66 is 2.2 microfarads, the value for the resistor 70 and 71 is 100 kilohms each and the value for the resistor 73 is ten kilohms.

In operation, the blind 10 is lowered and the electrical circuitry 44 activated by switching the master on/off switch 58 to the "on" position. The close proximity between the magnet 42 and the reed switch 40 prevents build up of charge on the capacitor 66, and thus, prevents actuation of the alarm generating device 54. Further, minor movements of the lower rail 26 relative to the window sill 18 by which the magnet 42 and reed switch 40 are momentarily moved out of proximity to one another, will also prevent sufficient build up of charge on the capacitor 66 to activate the alarm generating device 54. However, if the magnet 42 and reed switch 40 remain out of proximity to one another for greater than the delay time, sufficient charge will build up on capacitor 66 to cause the semi-conductor device 74 to be triggered to activate the alarm generating device 54. However, as can be appreciated, by changing the various components mounted on the circuit board 60, the length of time of the delay period can be easily adjusted to provide either a longer or shorter delay period depending on what is desired by the user of the alarm apparatus.

Thus, movement of the blind 10 relative to the window sill 18 which results in the magnet 42 and the reed switch 40 being out of proximity with one another for less than the delay time, will not cause the alarm condition signal to be generated to activate the alarm device 54. Such short periods of non-proximity may be the result of wind disturbances or momentary swinging of the blind 10 such as might result from accidental knocking of same. However, should an intruder attempt to enter the residence through the window incorporating the alarm apparatus, such as for example, when an intruder pushes aside the blind 10 or cuts the guide lines 23, 23′, the magnet 42 and reed switch 40 will be out of proximity of one another for greater than the delay period and an alarm condition signal will be generated which in turn will activate the alarm generating device 54 to alert an occupant in the house or for some other desired purpose such as causing tripping of a silent alarm, etc.

It is noted that in the preferred embodiment shown in the Figures, the magnet 42 is positioned in the window sill 18 and magnetic reed switch 40 is positioned in the lower rail 26 of the blind assembly 10 with electrical conductors for connection to the alarm circuit 44 passing inwardly through the blind assembly 10 to the upper channel 30. Thus, cutting of the guide lines 23, 23′ such as might occur when an intruder attempts to enter the residence, will result in the capacitor 66 being incapable of discharging through the reed switch 40. Therefore, charge will build up in the capacitor 66 and an alarm will be generated. It is further to be noted that this feature would not exist with other arrangements of the components, such as for example, if the magnet were mounted on the lower rail of the blind assembly and the reed switch 40 and the alarm circuitry supported in the lower sill 18. Then, if the guide lines were cut and the lower rail 26 allowed to rest on the window sill so that the magnet closes the reed switch, no alarm would sound as the capacitor 66 would continue to discharge through the switch 40. Thus, it is advantageous to have the electrical conductors for the magnetic reed switch 40 pass upwardly through or along the blind assembly 10 to the alarm circuit 44 mounted in the upper channel 30.

Further, it is to be noted that once the alarm generating device 54 is actuated, it will continue to sound the alarm until the apparatus is reset. This resetting of the apparatus is accomplished by switching "off" and then "on" the master on/off switch 58.

Furthermore, it is to be noted that in the preferred embodiment, the use of a magnet 42 and reed switch 40 results in a relatively inexpensive yet passive system which does not cause the power delivered by the battery 52 to be drained unnecessarily. This accordingly, is advantageous since it is possible to utilize the alarm apparatus for a longer time between battery changes. Still further, although not shown, a battery charge circuit could be incorporated in the apparatus which causes the LED indicator 56 to blink prior to power of the battery 52 reaching too low a level to activate the alarm generating device 54. Then, when the battery charge drops to a low threshold, the LED indicator 56 would stop blinking.

It should, of course, be understood that while in the preferred embodiments, the switch means 40 and actuating means 42 for the alarm apparatus comprise a reed switch and a magnet respectively, other types of sensing devices could be utilized depending on the particular environment in which the alarm apparatus is to be used. For example, sensing could be accomplished with optical detectors, radio frequency or alternating current detectors, sonic detectors, physical contacts which do not restrain movement of the barrier, temperature or pressure sensing devices, angular position and motion detection devices, etc. With such other sensing devices, the timing means would serve to delay generation of an alarm signal for a short period of time so as to distinguish between momentary movements of the barrier which might be the result of wind or other disturbances, and movements which might be the result of an attempted entry by an intruder.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. An alarm apparatus for use with a frame member defining an opening and a movable barrier member in the opening which is movable relative to the frame member, said alarm apparatus comprising:

switch means for mounting on one of said frame and barrier members, said switch means being switchable between a first operative state and a second operative state, and being normally in said first operative state;

actuating means for mounting on the other of said frame and barrier members, said actuating means switching said switch means to said second operative state when said actuating means is in a predetermined position relative to said switch means;

timing means responsive to said switch means being in said first operative state for greater than a predetermined period of time for generating an alarm condition signal; and alarm generating means responsive to said alarm condition signal for generating an alarm whereby generation of an alarm is delayed for said predetermined period of time to prevent generation of false alarms as a result of minor movements of said barrier member relative to said frame member.

2. The alarm apparatus of claim 1 wherein said switch means comprises a proximity detector and said actuating means comprises a proximity member, and wherein said predetermined position of said proximity member relative to said proximity detector is a position in which said proximity member is in close proximity to said proximity detector.

3. The alarm apparatus of claim 2 wherein said proximity detector comprises a magnetic reed switch and said proximity member comprises a magnet.

4. The alarm apparatus of claim 1 wherein said predetermined period of time is between ½ and 1½ seconds.

5. A barrier member mountable for relative movement with respect to a frame member defining an opening, said barrier member having an alarm apparatus associated therewith, said barrier member comprising:

a first member being supportable by said frame member in said opening;

a barrier depending from and being supported by said first member, said barrier being freely movable with respect to said frame member;

switch means mounted on a portion of said barrier which is movable relative to said frame member, said switch means being switchable between a first operative state and a second operative state, and being normally in said first operative state;

actuating means for mounting on said frame member, said actuating means switching said switch means to said second operative state when said actuating means is in a predetermined position relative to said switch means;

timing means responsive to said switch means being in said first position for greater than a predetermined period of time for generating an alarm condition signal; and alarm generating means responsive to said alarm condition signal for generating an alarm whereby generating of an alarm is delay for said predetermined period of time to prevent generation of false alarms as a result of minor movement of said barrier relative to said frame member.

6. The barrier member of claim 5 wherein said timing means and said alarm generating means are supported by said first member.

7. The barrier member of claim 6 wherein said switch means comprises a magnetic reed switch and said actuating means comprises a magnet, and wherein said predetermined position is a position of close proximity between said magnet and said magnetic reed switch.

8. The barrier member of claim 7 wherein said magnetic reed switch is mounted on the lower portion of said barrier and includes connectors for connecting said magnetic reed switch to said timing means, said connectors passing upwardly from said magnetic reed switch to said first member, and wherein said timing means also generates an alarm condition signal when said switch means is not connected to said timing means whereby said timing means generates an alarm condition signal if said connectors are disconnected by an intruder.

9. A method for detecting entry through an opening by an intruder, the opening including a barrier member supported therein and being freely movable relative to a frame member defining said opening, the method comprising the steps of:

mounting a switch means on one of said frame and barrier members, said switch means being switchable between a first operative state and a second operative state and being normally in said first operative state;

mounting an actuating means on the other of said frame and barrier members to be in a predetermined position relative to said switch means when said barrier member is supported without moving in said opening, said actuating means switching said switch means to said second operative state when said actuating means is in said predetermined position;

detecting the operative state of said switch means; and generating an alarm when said switch means is in said first operative state for greater than a predetermined period of time whereby generation of an alarm is delayed for said predetermined period of time to prevent generation of false alarms as a result of minor movements in said barrier member relative to said frame member.

10. The method of claim 9 wherein said predetermined period of time is between ½ and 1½ seconds.

* * * * *